US005600204A

United States Patent [19]

Jacobs et al.

[11] Patent Number: 5,600,204

[45] Date of Patent: Feb. 4, 1997

[54] HIGH-PRESSURE SODIUM DISCHARGE LAMP

[75] Inventors: Cornelis A. J. Jacobs, Turnhout, Belgium; Aldegondus W. Jansen, Eindhoven, Netherlands; Jan A. J. Stoffels, Turnhout, Belgium

[73] Assignee: U.S. Philips Corporation, New York, N.Y.

[21] Appl. No.: 434,896

[22] Filed: May 1, 1995

Related U.S. Application Data

[63] Continuation of Ser. No. 288,653, Aug. 10, 1994, abandoned, which is a continuation of Ser. No. 142,644, Oct. 25, 1993, abandoned, which is a continuation of Ser. No. 875,492, Apr. 29, 1992, abandoned, which is a continuation of Ser. No. 683,584, Apr. 10, 1991, abandoned, which is a continuation of Ser. No. 405,509, Sep. 11, 1989, abandoned.

[30] Foreign Application Priority Data

Sep. 12, 1988 [NL] Netherlands ..... 8802228

[51] Int. Cl.[6] ..... H01J 17/20

[52] U.S. Cl. ..... 313/572; 313/639; 313/642

[58] Field of Search ..... 313/572, 639, 313/642

[56] References Cited

U.S. PATENT DOCUMENTS

| | | | |
|---|---|---|---|
| 4,025,812 | 5/1977 | McVey | 313/555 |
| 4,260,929 | 4/1981 | Jacobs et al. | 313/642 X |
| 4,374,339 | 2/1983 | Tielemans et al. | 313/642 X |
| 4,418,300 | 11/1983 | Otani et al. | 313/642 X |
| 5,150,017 | 9/1992 | Geens et al. | 315/326 |

FOREIGN PATENT DOCUMENTS

| | | |
|---|---|---|
| 62-51935 | 3/1987 | Japan . |
| 1587987 | 4/1978 | United Kingdom . |

OTHER PUBLICATIONS

"Electric Discharge Lamps" By John F. Waymouth, pp. 196–198, Section 7.3, The M.I.T. Press, 1972.

*High Pressure Mercury Vapour Lamps and Their Applications* by Elenbaas, © 1965 p. 124.

*Primary Examiner*—Alvin E. Oberley
*Assistant Examiner*—Lawrence O. Richardson
*Attorney, Agent, or Firm*—Brian J. Wieghaus

[57] ABSTRACT

A high-pressure sodium discharge lamp provided with a ceramic discharge vessel, in which sodium, mercury and xenon are present, of which the xenon is at a pressure at 300K of at least 26.7 kPa. The sodium and the mercury are present in a weight ratio Na/Hg which is at least 0.075 and at most 0.125. The lamp generates in the operating condition a spectrum, in which at a wavelength of 589.3 nm a self-absorption band is present, which is limited by spectral flanks each flank having a respective maximum. There is a wavelength difference $\Delta\lambda$ of at least 3.5 nm and at most 6 nm between the maxima.

5 Claims, 4 Drawing Sheets

HIGH-PRESSURE SODIUM DISCHARGE LAMP

This is a continuation of application Ser. No. 08/288,653, filed Aug. 10, 1994, which is a continuation of application Ser. No. 08/142,644, filed on Oct. 25, 1993, which is a continuation of application Ser. No. 07/875,492, filed on Apr. 29, 1992, which is a continuation of application Ser. No. 07/683,584, filed on Apr. 10, 1991, which is a continuation of application Ser. No. 07/405,509, filed on Sep. 11, 1989, all now abandoned.

BACKGROUND OF THE INVENTION

The invention relates to a saturated high-pressure sodium discharge lamp provided with a ceramic discharge vessel, in which sodium, mercury and xenon are present, of which the xenon is at a pressure of at least 26.7 kPa (200 torr) at 300K, while the lamp generates in the operating condition a light spectrum, in which at a wavelength of 589.3 nm an absorption band is present, on either side of which spectral flanks are disposed each having a respective maximum, a wavelength difference $\Delta\lambda$ occurring between the said maxima.

A lamp of the kind mentioned in the opening paragraph is known from British Patent Specification 1,587,987 which corresponds to U.S. Pat. No. 4,260,929. The known lamp, which is frequently used inter alia in public illumination, is an efficient light source. During lamp operation, the vapor pressure of sodium and mercury is controlled by the cold spot of the discharge vessel because all of the sodium and mercury is not evaporated. The xenon serves as buffer gas, as a result of which the radiation efficiency and hence the luminous efficacy are improved with respect to high-pressure sodium lamps containing rare gas as starting gas, i.e. at a pressure up to 6.7 kPa (50 torr). The light spectrum generated in the operating condition by the two kinds of high-pressure sodium lamps is very uniform.

However, the light spectrum generated by these lamps comprises a comparatively small contribution in the blue part. This is an obstacle for the use of these lamps in certain applications.

SUMMARY OF THE INVENTION

The invention has for its object to provide a measure to improve the blue contribution in the blue part of the spectrum.

According to the invention, a saturated lamp of the kind mentioned in the opening paragraph is for this purpose characterized in that the sodium and the mercury are present in a weight ratio Na/Hg of at most 0.125 and at least 0.075 and in that the wavelength difference $\Delta\lambda$ is at least 3.5 nm and at most 6 nm.

The lamp according to the invention proves to have a contribution in the blue part of the spectrum (350–450 nm) which is 5 to 12% of the radiation power of the spectrum generated by the lamp between 250 and 780 nm. Such a comparatively large contribution in the blue part of the spectrum is associated with a radiation efficiency reduced with respect to the known lamp and also with a reduced luminous efficacy. However, the reduction is such that with the lamp according to the invention values for radiation efficiency and luminous efficacy are obtained which are comparable with those of high-pressure sodium lamps having xenon as starting gas. Reduction of the wavelength difference $\Delta\lambda$ results in an increase in the blue part of the spectrum, but this is associated with a strong decrease of the luminous efficacy. It has been found that, when the wavelength difference $\Delta\lambda$ is enlarged, this leads to decrease of the contribution in the blue part of the spectrum. It should be noted here that maxima for the luminous efficacy are attained at a wavelength difference $\Delta\lambda$ lying at about 10 nm.

The increased contribution in the blue part of the spectrum renders the lamp according to the invention particularly suitable for use in irradiation of plants because the spectral distribution produced favors both a strong plant growth (photosynthesis) and a good plant morphology. However, it is generally required for a good plant growth that the contribution in the wavelength range between 400 nm and 780 nm is at least 90% of the overall radiation power of the lamp. The term "overall radiation power" is to be understood herein to mean the power between 250 nm and 780 nm. A further advantage is that the color rendition of plants irradiated by the lamp according to the invention is improved. This permits of carrying out a visual inspection of the irradiated plants during the irradiation.

The wavelength difference $\Delta\lambda$ is a measure for the pressure of sodium and mercury in the discharge vessel, as described inter alia in J. J. de Groot and J. A. J. M. van Vliet "The high-pressure sodium lamp", 1986. In this case, the wavelength difference $\Delta\lambda$ can then be assumed to be built up of a proportion $\Delta\lambda_B$ lying between 589.3 nm and the maximum of the flank on the short-wave side of the self-absorption band on the one hand and a proportion $\Delta\lambda_R$ lying between 589.3 nm and the maximum of the flank on the long-wave side of the said self-absorption band on the other hand. Although the proportions $\Delta\lambda_B$ and $\Delta\lambda_R$ vary in dependence upon the sodium/mercury ratio, it has been found that for the desired influencing of the generated light spectrum the wavelength difference $\Delta\lambda$ is of decisive importance.

BRIEF DESCRIPTION OF THE DRAWINGS

The invention will now be described more fully with reference to a drawing, in which.

DESCRIPTION OF THE PREFERRED EMBODIMENTS

Figure 1:
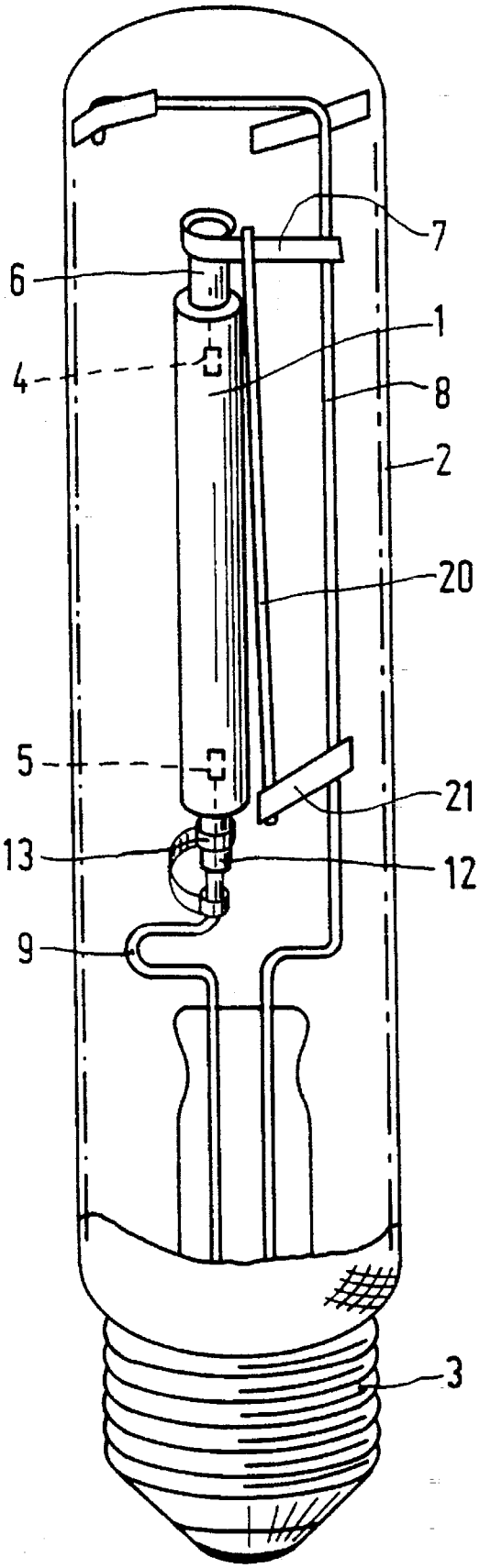
FIG. 1 is a side elevation of a lamp partly broken away according to the invention.

In the lamp shown in FIG. 1, reference numeral 1 designates a discharge vessel having a ceramic wall and reference numeral 2 designates an outer envelope, which encloses the discharge vessel and is provided at one end with a lamp cap 3. Means for manufacturing a gas discharge lamp within said discharge vessel is comprised of with electrodes 4, 5, at opposite ends of the discharge vessel each connected to a lead-through element 6 and 12, respectively. The lead-through element 6 is connected through a conductor 7 to a rigid current conductor 8, which is connected at one end to a first contact point (not shown) of the lamp cap 3. Another end of the rigid current conductor 8 is flanged and serves as supporting means within and on the outer envelope 2. The lead-through element 12 is connected via a Litze wire 13 to a rigid current conductor 9, which is connected at one end to a second contact point (not shown) of the lamp cap 3.

The discharge vessel 1 is provided with an aerial 20, which is electrically connected at one end to the conductor 7. Another end of the aerial 20 is connected to a bimetal element 21, which is secured to the rigid current conductor 8. In the inoperative condition of the lamp, the bimetal element 21 bears on the wall of the discharge vessel so that the aerial engages the wall of the discharge vessel. In the operative condition of the lamp, the bimetal element is heated by the radiation emitted by the discharge vessel in such a manner that the bimetal element bends away from the discharge vessel, as a result of which the aerial 20 is removed for the major part from the wall of the discharge vessel. The filling of the discharge vessel consisted of 26 mg of sodium and mercury in a weight ratio Na/Hg of 0.125 and xenon at a pressure of 40 kPa at about 300K. The lamp shown has a nominal power of 400 W, an arc voltage of 100 V and an electrode gap of 90 mm.

TABLE I

| Lamp number | 1 | 2 | 3 | 4 | 5 | 6 | 7 |
|---|---|---|---|---|---|---|---|
| Weight ratio Na/Hg | 0.225 | 0.225 | 0.125 | 0.125 | 0.075 | 0.075 | 0.075 |
| Luminous efficacy (lm/W) | 117 | 130 | 126 | 123 | 113 | 104 | 87 |
| Radiation efficiency (mW/W) | 324 | | 327 | 299 | 285 | 251 | 223 |
| Wavelength (nm) | 7.4 | 9.0 | 6.6 | 4.8 | 4.2 | 3.5 | 2.7 |
| Proportion wavelength difference $\Delta\lambda_B$ (nm) | 3.2 | 2.6 | 2.8 | 1.9 | 1.2 | 1.2 | 0.8 |
| Contribution in percent of radiation power in wavelength range | | | | | | | |
| 250 nm–780 nm | 100 | 100 | 100 | 100 | 100 | 100 | 100 |
| 400 nm–780 nm | 96 | 95 | 95 | 95 | 93.7 | 90.7 | 89.2 |
| 350 nm–450 nm | 3.9 | 4 | 4.2 | 5.8 | 7.8 | 12 | 14.6 |

Figure 2:
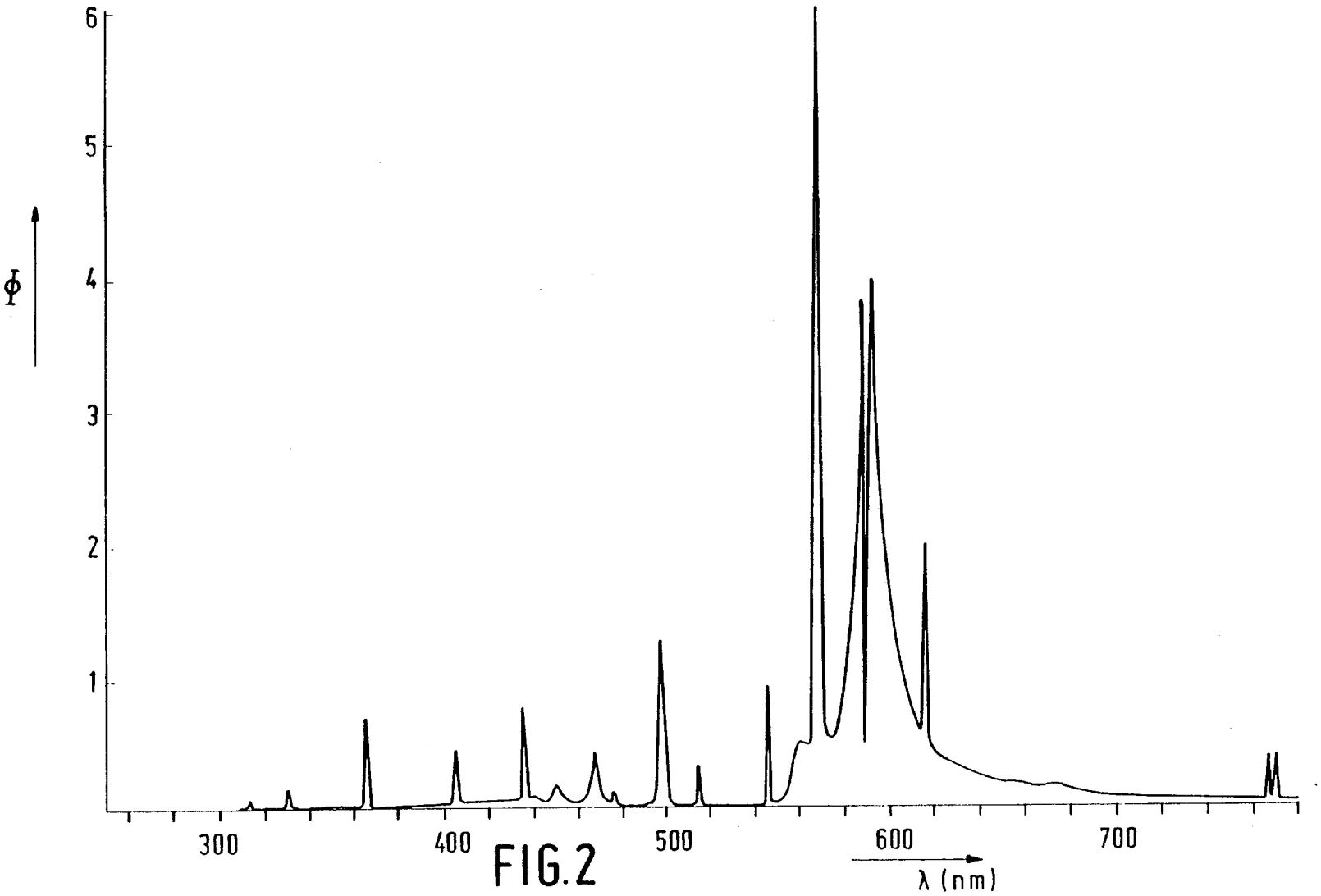
FIG. 2 shows a spectrum of the light emitted by the lamp shown in FIG. 1.
Figure 3:
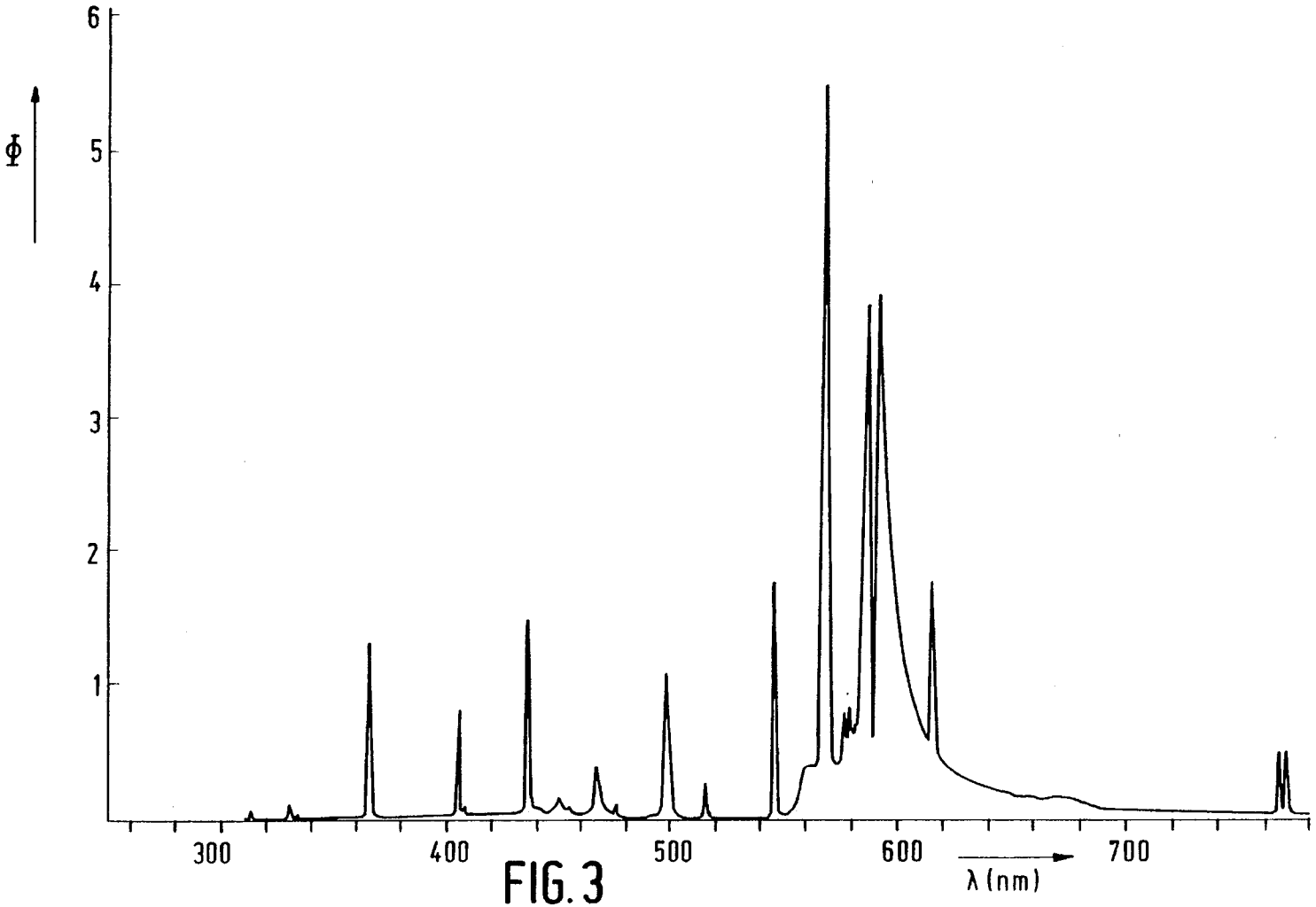
FIG. 3 shows a spectrum generated by another lamp according to the invention.
Figure 4:
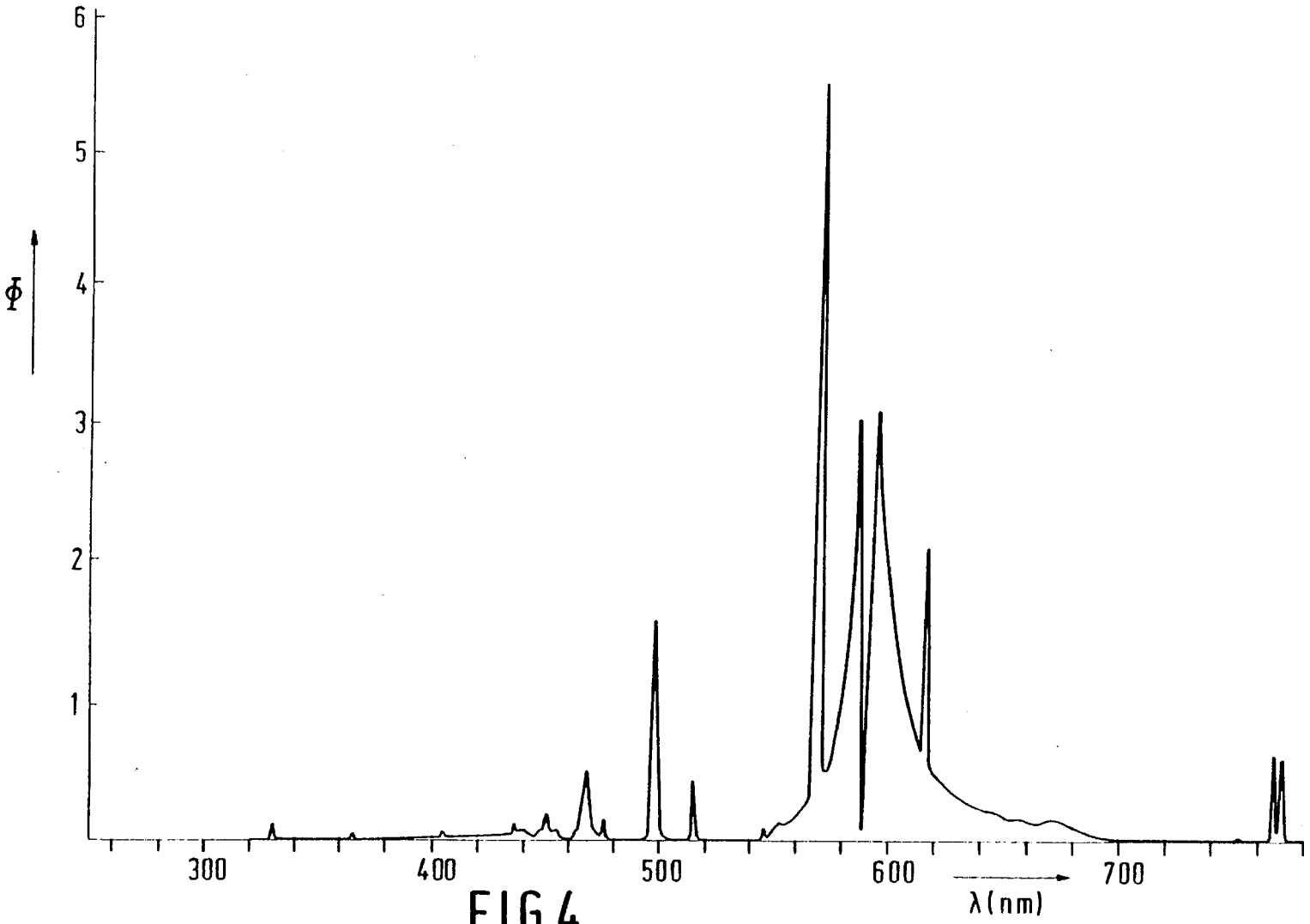
FIG.4 PRIOR ART
FIG. 4 shows a spectrum generated by a prior art high-pressure sodium lamp containing Xe as starting gas.

Table I indicates spectral measurement results for seven different lamps. All lamps contained 26 mg of Na-Hg-amalgam. The lamp 1 had a xenon pressure at 300K of 3.6 kPa, while the lamps 2 to 7 inclusive had a xenon pressure of 40 kPa. The lamps 4, 5 and 6 are lamps according to the invention. The spectrum of the lamp 4 is shown in FIG. 2 and the spectrum of the lamp 5 is shown in FIG. 3. The lamps 2 and 3 are lamps according to the prior art and their spectrum corresponds to that of the lamp 1, which is shown in FIG. 4. In FIGS. 2, 3 and 4, the wavelength $\lambda$ is plotted in nm on the abscissa. The radiation power $\Phi$ (radiation energy current) is plotted in a relative measure on the ordinate. Only the luminous efficacy of the lamps 2 and 3 is considerably higher than in the case of the lamp 1.

It is clear that the lamps according to the invention have a luminous efficacy which is comparable with that of the known high-pressure sodium lamp containing Xe as starting gas (lamp 1). The proportion of the radiation power then markedly increases in the blue part of the spectrum (350 nm–450 nm).

In the lamp 7, the proportion in the blue part of the spectrum has further increased, but to a great extent at the expense of the luminous efficacy. Moreover, it has been found that the proportion of the radiation power in the part of the spectrum important for plant growth (400 nm–780 nm) falls below 90%. The radiation efficiency of this lamp is also considerably lower than that of the remaining lamps. These aspects render the lamp less suitable for use as plant irradiation light source.

We claim:

1. A saturated high-pressure sodium discharge lamp comprising a discharge device having a filling of sodium and mercury, and xenon at a pressure of at least 26.7 kPA (200 torr) at a temperature of 300K, and means for maintaining a gas discharge within said discharge device during lamp operation, said discharge device generating during lamp operation a light spectrum having a self-absorption band at 589.3 nm and a spectral flank on both sides of said self-absorption band each having a respective maximum, said maxima being separated by a wavelength difference $\Delta\lambda$, the improvement comprising:

said sodium and mercury having a weight ratio (Na/Hg) of at least 0.075 and at most 0.125; and said wavelength difference $\Delta\lambda$ is at least 3.5 nm and at most 6 nm.

2. A saturated high-pressure sodium discharge lamp according to claim 1, wherein said xenon is at a pressure of approximately 40 kPA at 300K.

3. A saturated high-pressure sodium discharge lamp according to claim 2, wherein said discharge device comprises a ceramic discharge vessel.

4. A saturated high-pressure sodium discharge lamp comprising a ceramic discharge vessel having a filling comprising sodium and mercury, and xenon at a pressure of at least 26.7 kPA (200 torr) at 300K, and means for maintaining a gas discharge within said discharge vessel during lamp operation, said lamp generating a light spectrum having a self-absorption band at a wavelength of 589.3 nm and respective spectral maxima on either side of said self-absorption band separated by a wavelength of $\Delta\lambda$, the improvement comprising:

said sodium and mercury being present in a weight ratio (Na/Hg) of at least 0.075 and at most 0.125; and said wavelength difference $\Delta\lambda$ being at least 3.5 nm and at most 6 nm.

5. In a saturated high-pressure sodium discharge lamp comprising a discharge device having a filling of sodium and mercury, and xenon at a pressure of at least 26.7 kPA (200 Torr) at a temperature of 300K, and means for maintaining a gas discharge within said discharge device during lamp operation, said discharge device generating during lamp operation a light spectrum having a self-absorption band at 589.3 nm and a spectral flank on both sides of said self-absorption band each having a respective maximum, said maxima being separated by a wavelength difference $\Delta\lambda$, and a radiation power lying in a wavelength range of 250 to 780 nm, of which a first proportion lies in wavelength of 400 nm to 780 nm and is at least 90% of the radiation power, the improvement comprising:

said filling of sodium and mercury being selected such that said discharge device has sodium and mercury pressures during lamp operation which provide a second proportion of said radiation power in the range 350 nm to 450 nm which is greater than or equal to 5% of said radiation power and less than or equal to 12% of said radiation power; and said wavelength difference $\Delta\lambda$ being at least 3.5 nm and at most 6 nm.

* * * * *